US007677917B2

(12) United States Patent
Hemmi et al.

(10) Patent No.: US 7,677,917 B2
(45) Date of Patent: Mar. 16, 2010

(54) ELECTRICAL CONNECTOR WITH LEVER

(75) Inventors: Yoshinobu Hemmi, Kawasaki (JP); Hirotada Teranishi, Kawasaki (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 12/335,294

(22) Filed: Dec. 15, 2008

(65) Prior Publication Data

US 2009/0170367 A1 Jul. 2, 2009

(30) Foreign Application Priority Data

Dec. 28, 2007 (JP) ..... 2007-339695

(51) Int. Cl.
*H01R 12/24* (2006.01)

(52) U.S. Cl. ..... 439/495

(58) Field of Classification Search ..... 439/260, 439/261, 492, 493, 495, 276
See application file for complete search history.

(56) References Cited

U.S. PATENT DOCUMENTS 6,089,905 A * 7/2000 Shimmyo et al. ..... 439/495
6,855,002 B2 * 2/2005 Chiu ..... 439/495
7,140,896 B2 * 11/2006 Takai et al. ..... 439/260
7,147,498 B1 * 12/2006 Gillespie et al. ..... 439/260
7,255,584 B2 * 8/2007 Takashita ..... 439/260
7,300,304 B1 * 11/2007 Takashita ..... 439/495
7,311,542 B2 * 12/2007 Suzuki ..... 439/260
7,347,720 B2 * 3/2008 Takashita ..... 439/495
7,387,528 B2 * 6/2008 Lee et al. ..... 439/495
7,416,438 B2 * 8/2008 Hashiguchi et al. ..... 439/495
7,445,495 B2 * 11/2008 Takashita ..... 439/495
7,452,227 B2 * 11/2008 Matoba et al. ..... 439/260
2005/0260885 A1 * 11/2005 Lu ..... 439/495
2006/0292910 A1 * 12/2006 Lee et al. ..... 439/260
2007/0032115 A1 * 2/2007 Takashita ..... 439/260
2007/0202736 A1 * 8/2007 Takashita ..... 439/495
2008/0003858 A1 * 1/2008 Little et al. ..... 439/260
2008/0081501 A1 * 4/2008 Hemmi et al. ..... 439/329
2009/0170352 A1 * 7/2009 Hemmi et al. ..... 439/78

FOREIGN PATENT DOCUMENTS

JP 2002-190360 A 7/2002

* cited by examiner

*Primary Examiner*—Neil Abrams
*Assistant Examiner*—Harshad C Patel
(74) *Attorney, Agent, or Firm*—Osha • Liang LLP

(57) ABSTRACT

A connector in which a connection terminal is not pushed out from a housing even if an operation lever is mistakenly and excessively rotated is provided. When an operation lever is rotated for opening, a contact portion of the operation lever rides on a position regulating surface of a base before an upper surface of the operation lever contacts an edge of an upper surface on a rear surface side of the base, so that the operation lever is lifted upward.

2 Claims, 12 Drawing Sheets

ELECTRICAL CONNECTOR WITH LEVER

BACKGROUND OF THE INVENTION

1. Technical Field

The present invention relates to connectors, in particular, to a connector for connecting to a connecting portion arranged at a distal end of a flexible printed circuit board.

2. Related Art

Conventionally, for a connector, for example, as shown in Japanese Patent Application Laid-Open No. 2002-190360, there is a printed wiring board connector, including a housing with a substrate insertion groove to be inserted with a printed wiring substrate having a terminal portion arranged with numerous printed wiring terminals on the front and the back, in which numerous contact pieces that oppose in a front and back direction of the printed wiring terminal in the substrate insertion groove of the housing and sandwich the terminal portions of the printed wiring substrate are lined, where one of the opposing contact pieces is formed as a sandwich operation contact piece and the other contact piece is separately formed at a position facing the sandwich operation contact piece as an opposing side contact piece, a sandwich operation that operates the sandwich operation contact piece to a side of sandwiching the terminal portion of the printed wiring substrate inserted in the substrate insertion groove is arranged, a terminal piece is integrally formed at each contact piece, and each terminal piece is projected to outside the housing, (refer to, for example, Japanese Patent Application Laid-Open No. 2002-190360).

SUMMARY

However, in the above described connector, when an operator 16, which is an operation lever, is rotated to the opening side before mounting the printed circuit board, as shown in FIGS. 4 and 6 of Japanese Patent Application Laid-Open No. 2002-190360, an upper surface of the operator 16 contacts an upper surface edge of a housing 4, which is a base, if the operation lever is mistakenly and excessively rotated. From principle of leverage, a component force in a horizontal direction acts on a contacting portion 20, which is a connection terminal, whereby the contacting portion 20 is pushed out from the housing 4, and the connector cannot be mounted on the printed circuit board.

In view of the above problem, it is an object of the present invention to provide a connector in which a connection terminal is not pushed out from the housing even if the operation lever is mistakenly and excessively rotated.

In order to solve the above problem, a connector according to the present invention includes a base having an opening to which a distal end of a flexible printed circuit board is inserted formed on a front surface, a plurality of insertion holes passing from the front surface to a rear surface adjacently arranged at a predetermined pitch, and a position regulating surface of one step lower formed at an edge of an upper surface on the rear surface side; a connection terminal to be inserted to the insertion hole from the rear surface side, the connection terminal being arranged in a projecting manner with a substantially T-shaped operation piece having, at a first end, a movable contacting point that pressure-contacts a connecting portion adjacently arranged at the distal end of the flexible printed circuit board; and an operation lever having an upper surface of the connection terminal as a rotation supporting point, including a cam portion for driving an operation receiving portion positioned at a second end of the operation piece, and being formed with a contact portion that rides on the position regulating surface of the base at an edge of the upper surface on the front surface side; wherein when the operation lever is rotated for opening, the contact portion of the operation lever rides on the position regulating surface of the base before the upper surface of the operation lever contacts the edge of the upper surface on the rear surface side of the base, so that the operation lever is lifted upward.

According to the present invention, even if the operation lever is excessively rotated to the opening side, the contact portion arranged at the edge of the upper surface on the front surface side of the operation lever rides on the position regulating surface of one step lower arranged at the upper surface of the base, whereby the operation lever is lifted upward. Thus a large component force does not act in the horizontal direction on the connection terminal, and the connection terminal is not pushed out to the outside, whereby the connector can be mounted on the printed circuit board.

As an embodiment of the present invention, a rotation recess acting as a rotation supporting point of the cam portion of the operation lever may be arranged at the upper surface of the connection terminal.

According to the present embodiment, the connection terminal is not pushed out to the outside, and the rotation operation of the operation lever becomes more accurate since the rotation recess is arranged.

DETAILED DESCRIPTION

An embodiment of the present invention will be described according to the accompanied drawings of FIGS. 1 to 12.

Figure 1:
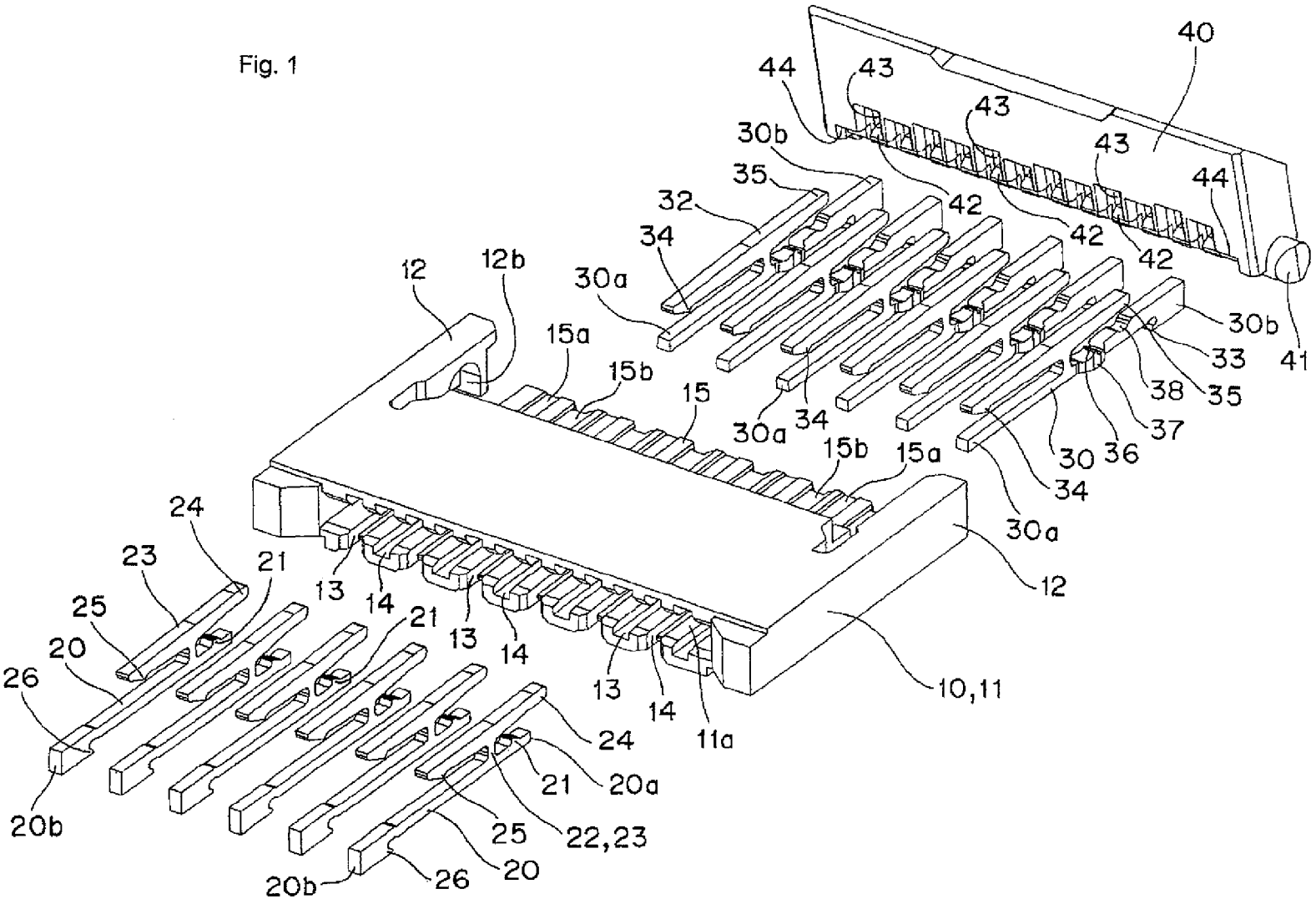
FIG. 1 shows an exploded perspective view showing an embodiment of a connector according to the present invention.
Figure 2A:
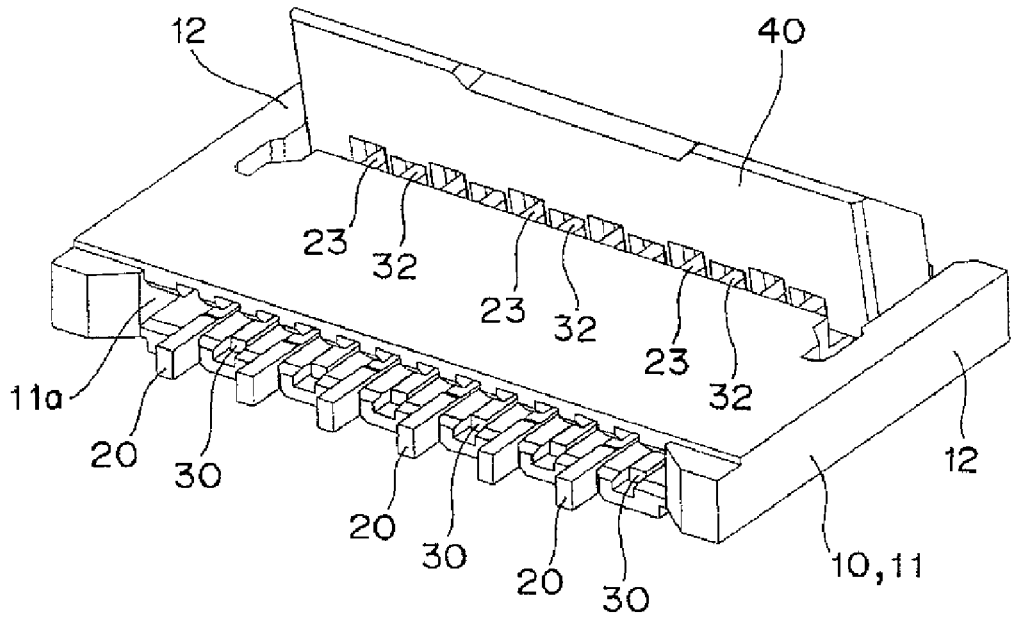
FIGS. 2A and 2B show perspective views seen from one side showing before and after the operation of the connector shown in FIG. 1.
Figure 2B:
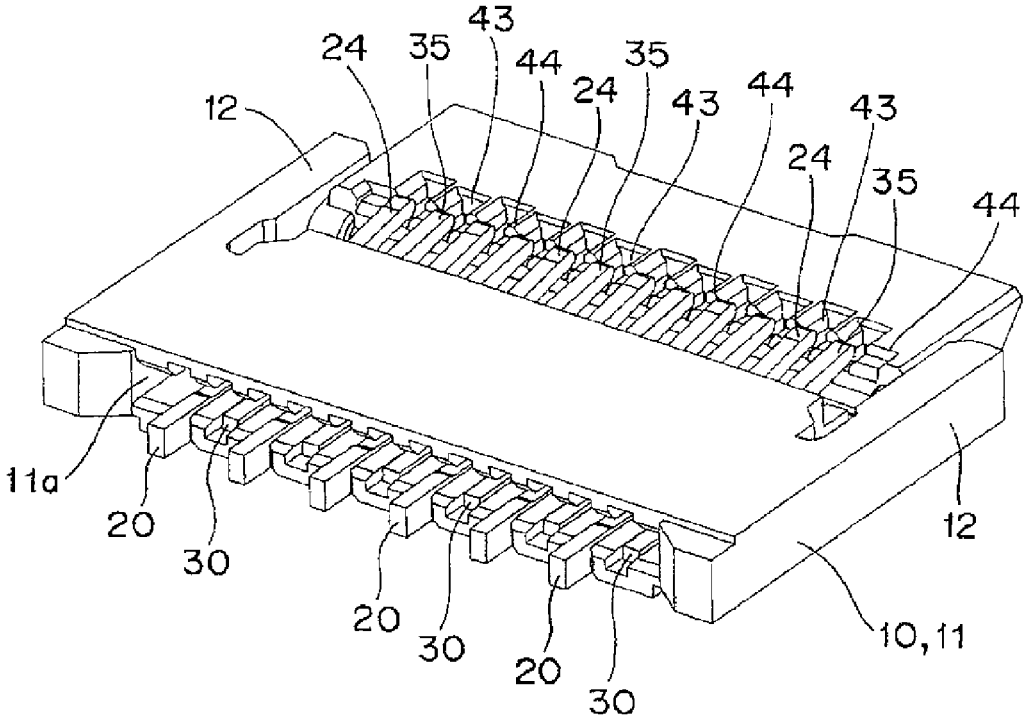
Figure 3A:
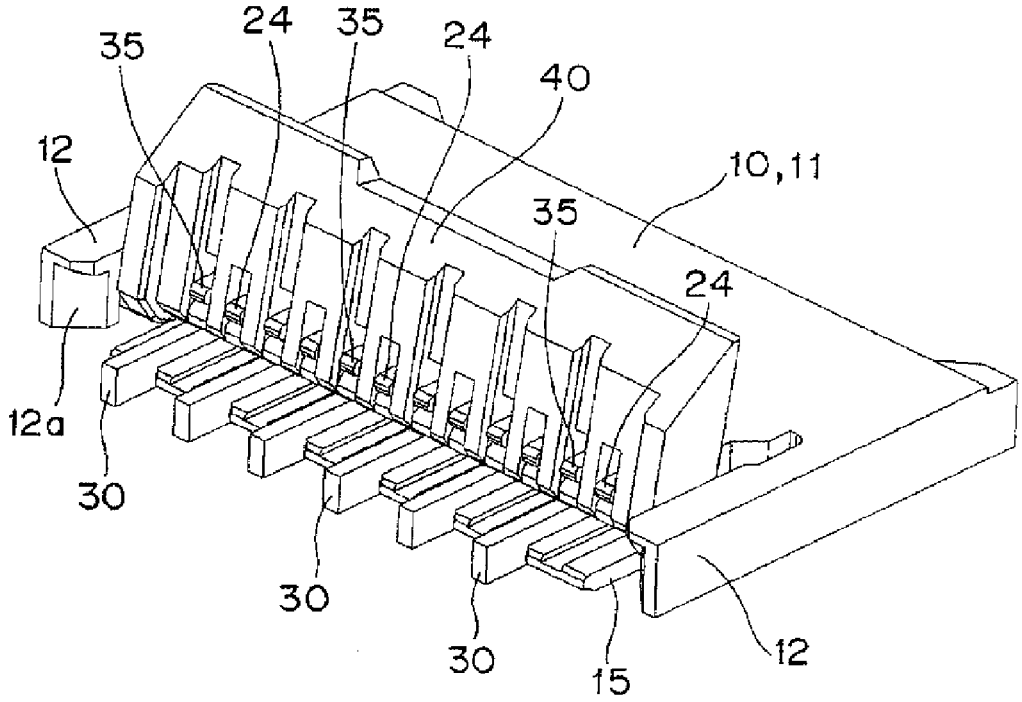
FIGS. 3A and 3B show perspective views seen from the other side showing before and after the operation of the connector shown in FIG. 1.
Figure 3B:
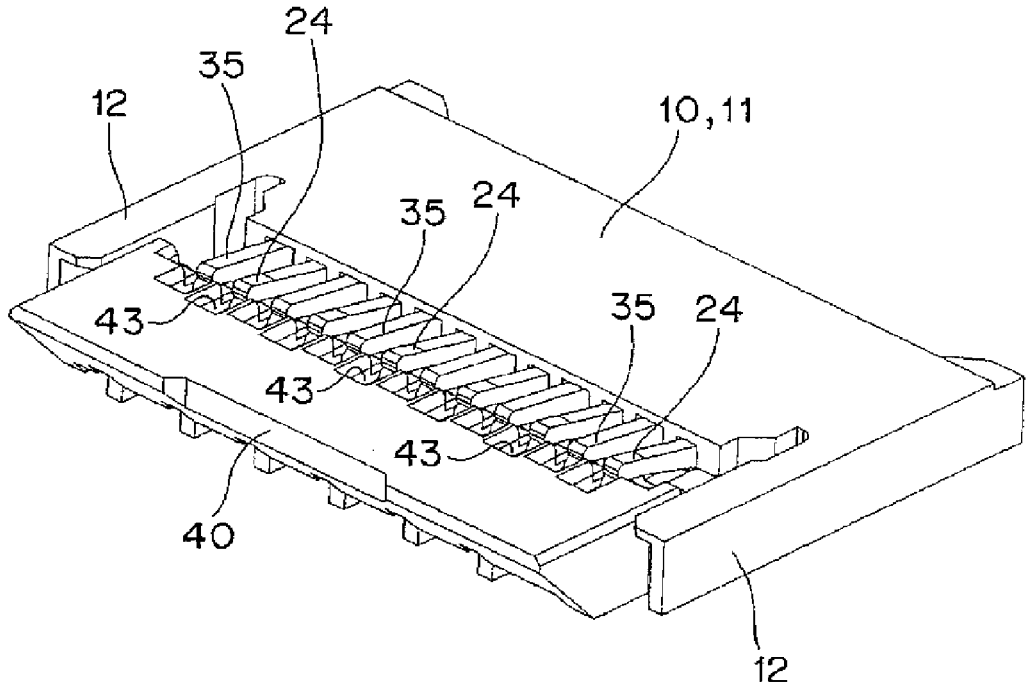
Figure 4A:
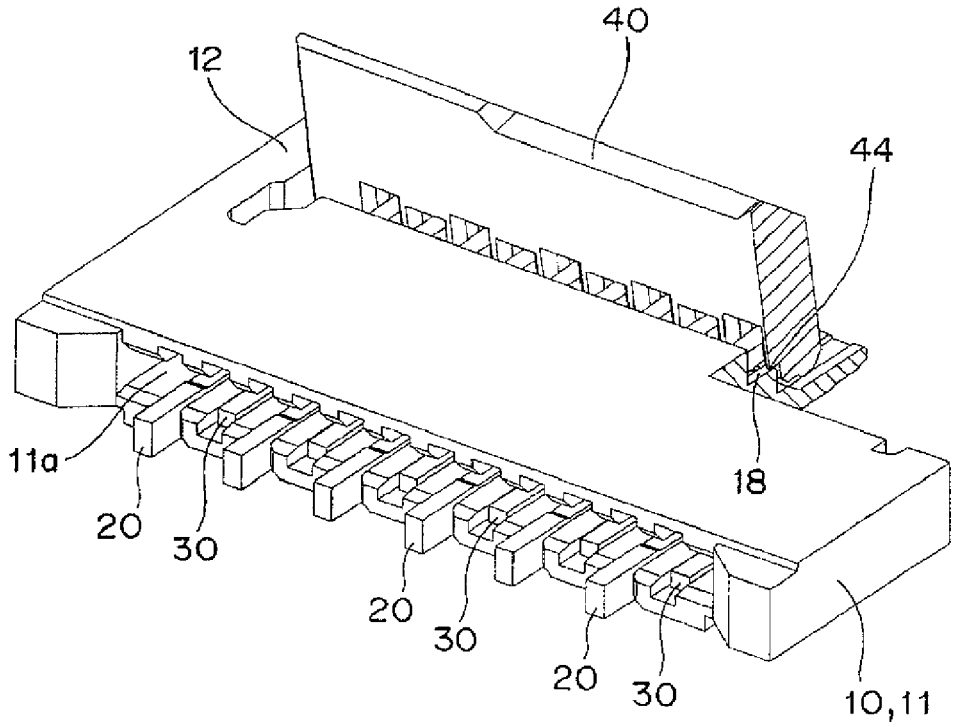
FIGS. 4A and 4B show partially broken perspective views of FIGS. 2A and 3A.
Figure 4B:
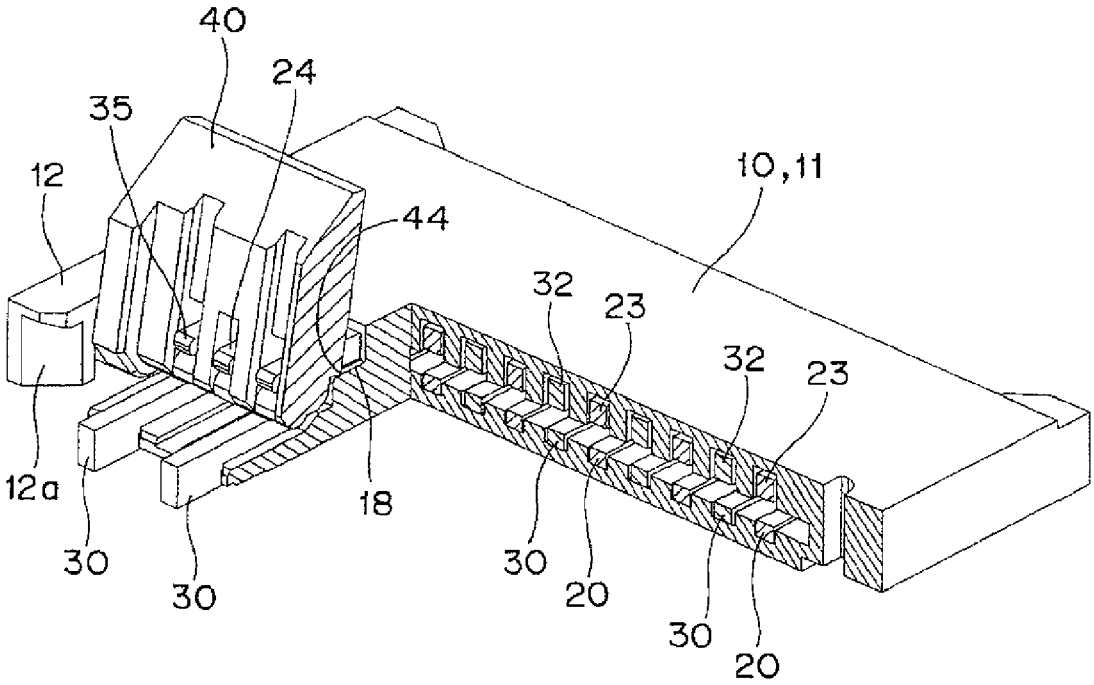

As shown in FIG. 1, a connector 10 according to a first embodiment roughly includes a base 11, a first connection terminal 20, a second connection terminal 30, and an operation lever 40.

Figure 9A:
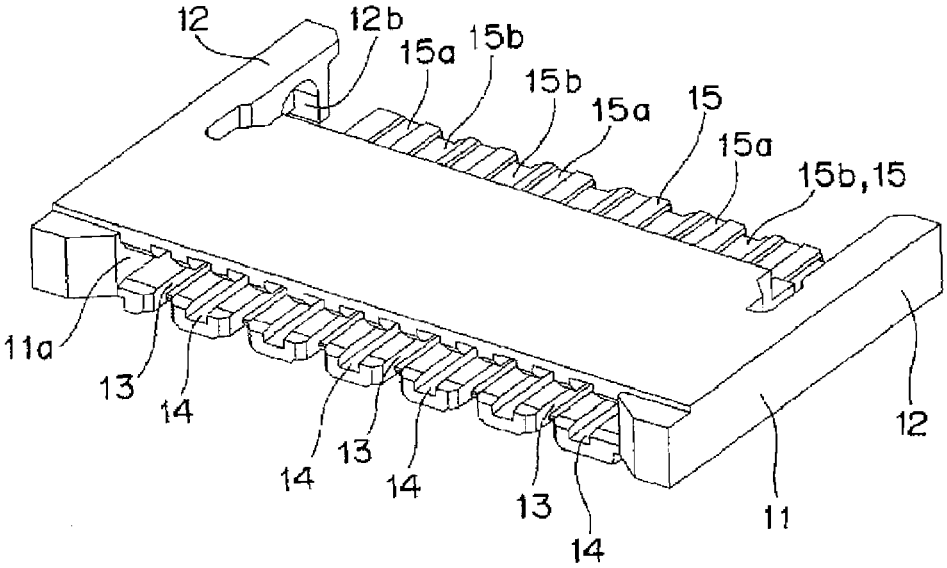
FIGS. 9A and 9B show perspective views seen from different angles of a housing shown in FIG. 1, and FIG. 9C show a partially enlarged perspective view of the housing.
Figure 9B:
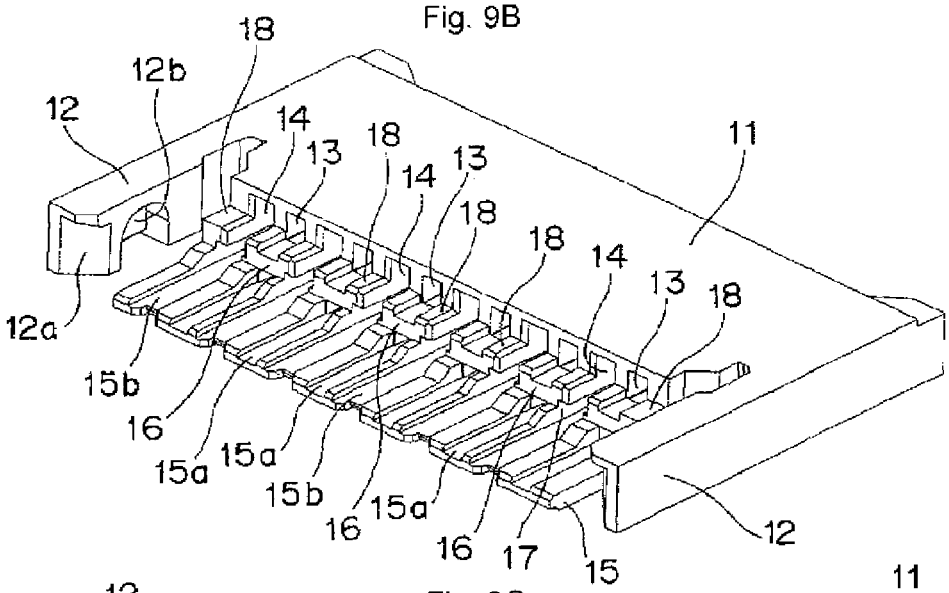

As shown in FIGS. 9A and 9B, the base 11 has elastic arms 12, 12 extending in parallel at a rear surface side from one side edge on both side end faces. Of an inward surface of the elastic arm 12, a guide tapered surface 12*a* is formed at a distal end edge, and a bearing slit 12*b* is formed on a far side thereof.

As shown in FIG. 9A, the base 11 includes, on a front surface side, an opening 11*a* to which a distal end 51 of a flexible printed circuit board 50, to be hereinafter described, can be inserted, and has first insertion holes 13 passing from a front surface to a rear surface and being adjacently arranged at a predetermined pitch.

Figure 9C:
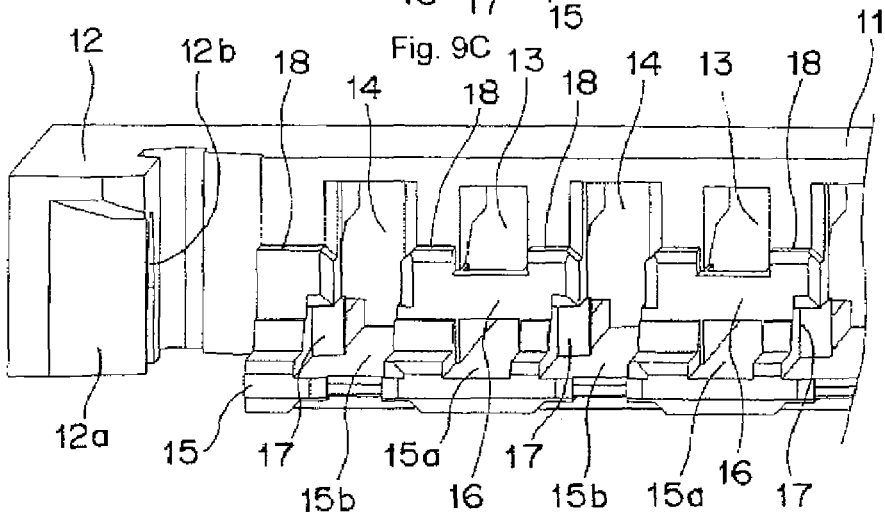

As shown in FIG. 9B, the base 11 has a guide plate 15 extending between the elastic arms 12, 12 from a lower edge at the rear surface, and has second insertion holes 14 adjacently arranged so as to be positioned between the first insertion holes 13. In particular, as shown in FIG. 9C, a slip-out preventing portion 16 is formed on the first insertion hole 13 so as to be bridged over. A slip-out preventing recess 17 is formed on an inner side surface of the second insertion hole 14. Furthermore, discontinuous position regulating surfaces 18 for regulating the position of the operation lever 40, to be hereinafter described, are formed at both ends of the upper surface of the slip-out preventing portion 16, and the like.

The base 11 has guide grooves 15*a*, 15*b* communicating to the first and the second insertion holes 13, 14, respectively, alternately arranged side by side at a predetermined pitch on the upper surface of the guide plate 15.

Figure 10A:
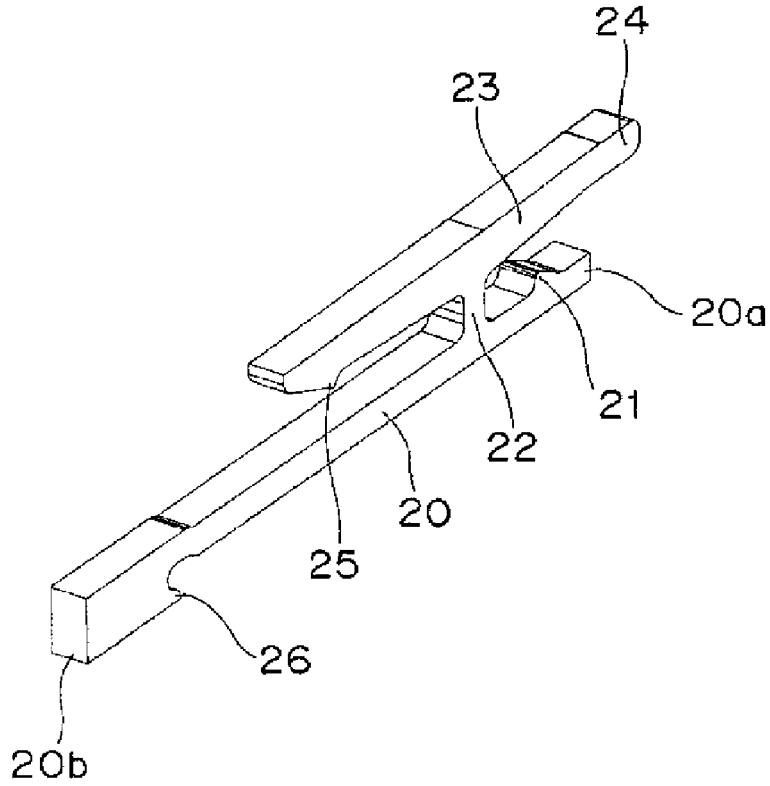
FIGS. 10A and 10B show perspective views seen from different angles of the first connection terminal shown in FIG. 1.
Figure 10B:
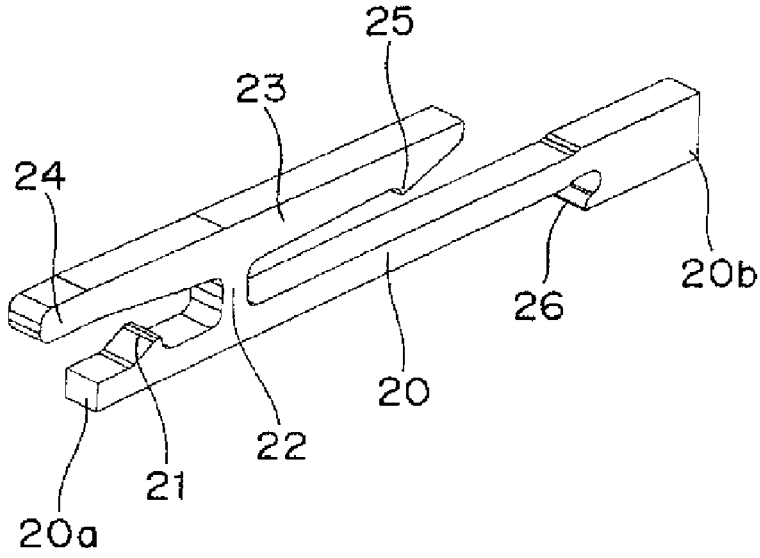

As shown in FIGS. 10A and 10B, the first connection terminal 20 has a slip-out preventing projection 21 formed in the vicinity of a first end 20*a* to be inserted to the first insertion hole 13 of the base 11, and a substantially T-shaped operation piece 23 with a support 22 arranged in a projecting manner at the vicinity of the slip-out preventing projection 21. The operation piece 23 has a first end serving as an operation receiving portion 24 and has a first movable contacting point 25 projecting to the lower side arranged at a second end. The first connection terminal 20 has a lock nail 26 that is locked to the edge of the base 11 arranged on the lower side of a second end 20*b* thereof.

As shown in FIGS. 11A to 11D, the second connection terminal 30 has a first end 30*a* that can be inserted to the second insertion hole 14 of the base 11, a substantially T-shaped operation piece 32 with a support 31 arranged in a projecting manner from an intermediate part; and a lock nail 33 arranged at a lower edge of a second end 30*b*. A first end of the operation piece 32 is arranged with a second movable contacting point 34 projecting to the lower side, and a second end thereof is an operation receiving portion 35. Furthermore, the second connection terminal 30 is arranged with a lock nail 37 in a projecting manner at a protrusion 36 formed by projecting a base of the operation piece 32 to the side. A rotation recess 38 is formed between the second end 30*b* and the protrusion 36.

Figure 11A:
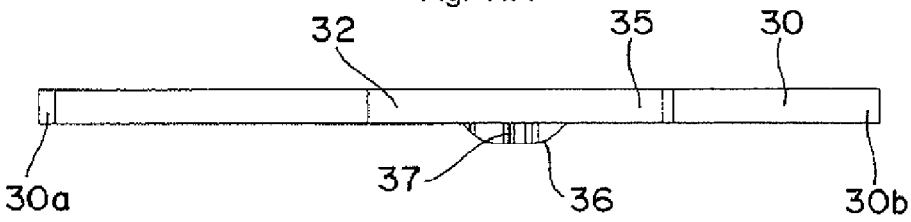
FIGS. 11A and 11B show a plan view and a side view of a second connection terminal shown in FIG. 1, and FIGS. 11C and 11D show perspective views seen from different angles of the second connection terminal.
Figure 11B:
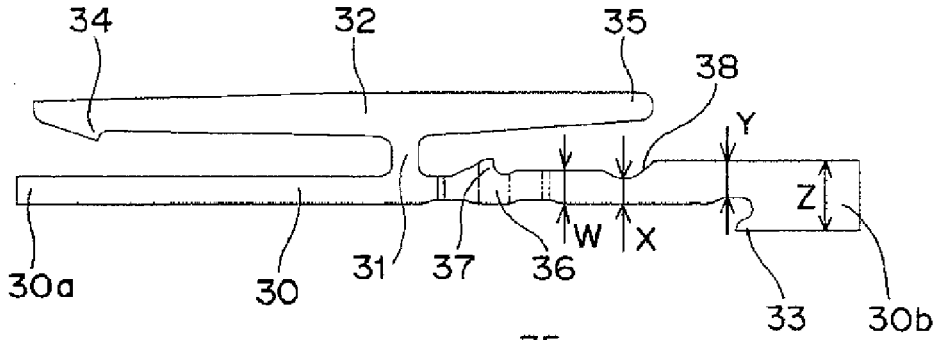
Figure 11C:
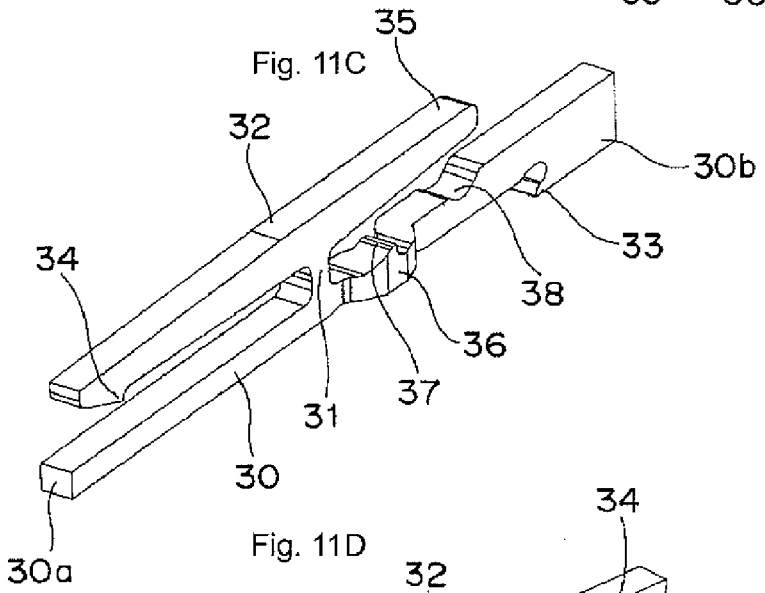
Figure 11D:
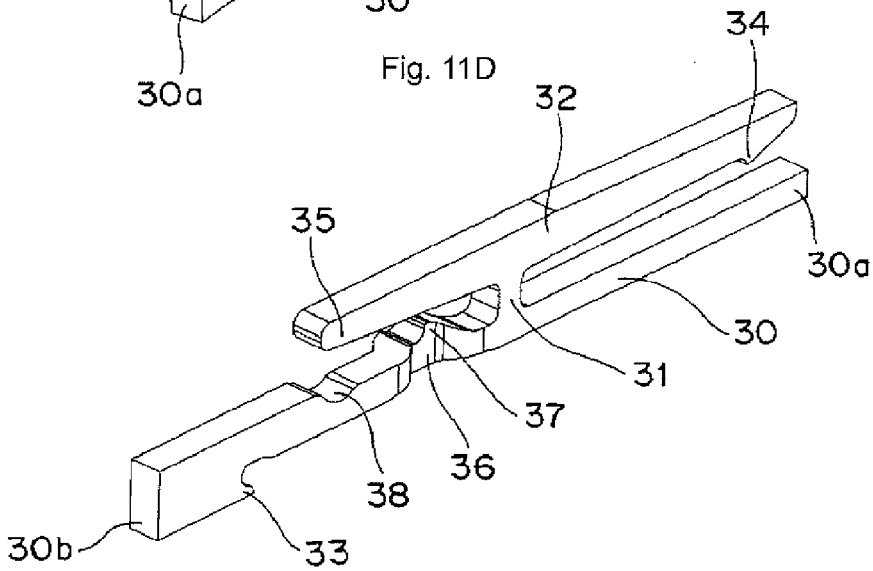
Figure 12A:
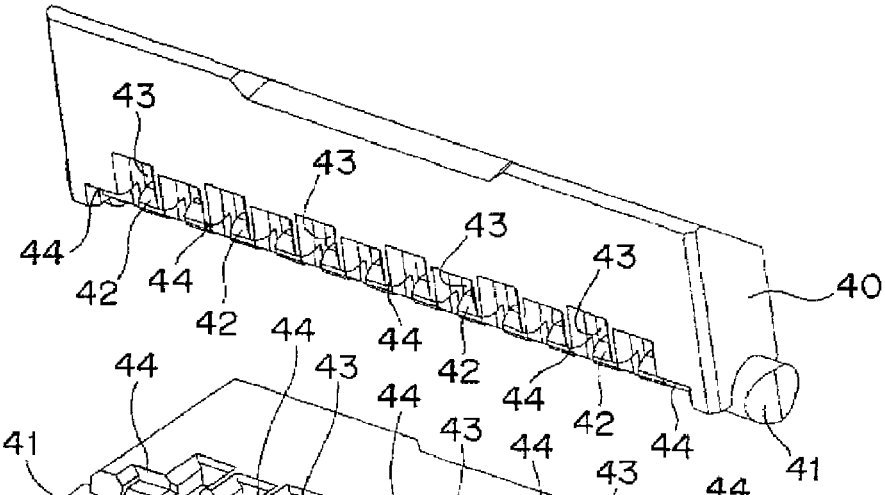
FIGS. 12A, 12B, 12C, and 12D show perspective views seen from different angles of an operation lever shown in FIG. 1.
Figure 12B:
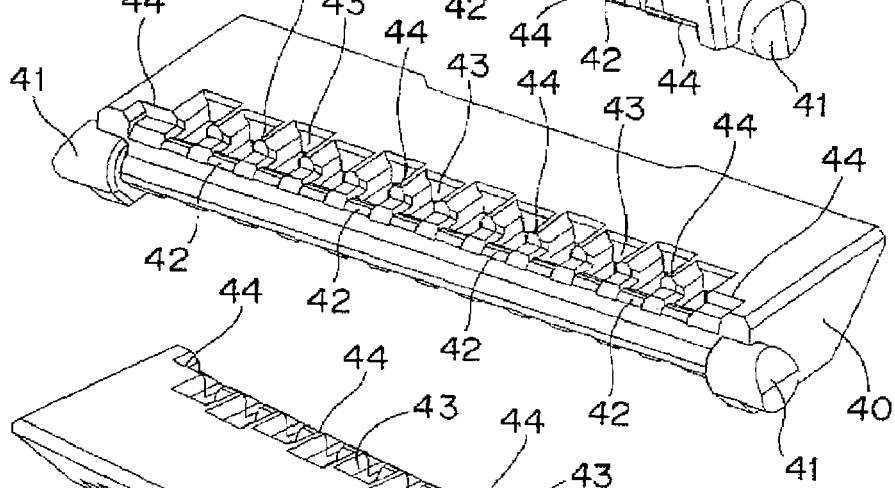
Figure 12C:
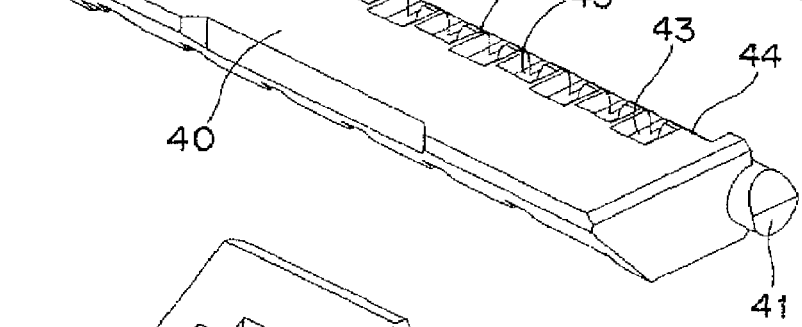
Figure 12D:
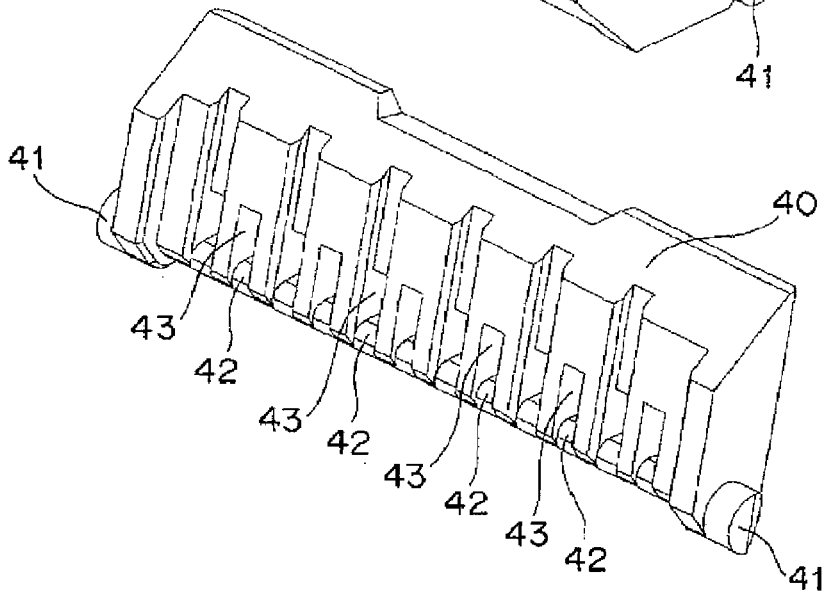

In particular, as shown in FIG. 11B, the second connection terminal 30 has a substantial height Y at the lock nail 33 higher than a substantial height W between the protrusion 36 and the rotation recess 38, and a substantial height X at the rotation recess 38, and furthermore, has a substantial height Z near the end face of the second end 30*b* further increased to enhance the rigidity. Thus, even if the second connection terminal 30 is press fitted to the second insertion hole 14 of the base 11, the second end 30*b* does not buckle and the assembly task can be smoothly carried out. Furthermore, even if the second connection terminal 30 punched out from a lead frame (not shown) is assembled to the housing 11 and then broken off from the connecting portion of the carrier of the lead frame, plastic deformation does not occur at the second end 30*b*, and the yield is satisfactory.

Furthermore, the second connection terminal 30 has the upper surface from the rotation recess 38 to the end face on the second end 30*b* formed as a flat surface. Thus, an advantage in that the assembly of the operation lever 40, to be hereinafter described, is easy is obtained.

As shown in FIGS. 12A to 12D, the operation lever 40 has rotation shafts 41, 41 arranged in a projecting manner on the same axis center at both side end faces. The operation lever 40 has a cam portion 42 for operating the operation receiving portions 24, 35 of the first and the second connection terminals 20, 30 adjacently arranged at a predetermined pitch on one side edge, and a pass through hole 43 to which the operation receiving portion 24, 35 is inserted adjacently arranged at a position corresponding to the cam portion 42. The operation lever 40 also has a contact portion 44 formed so as to ride over the position regulating surface 18 of the base 11 at the vicinity of the pass-through hole 43.

Figure 5:
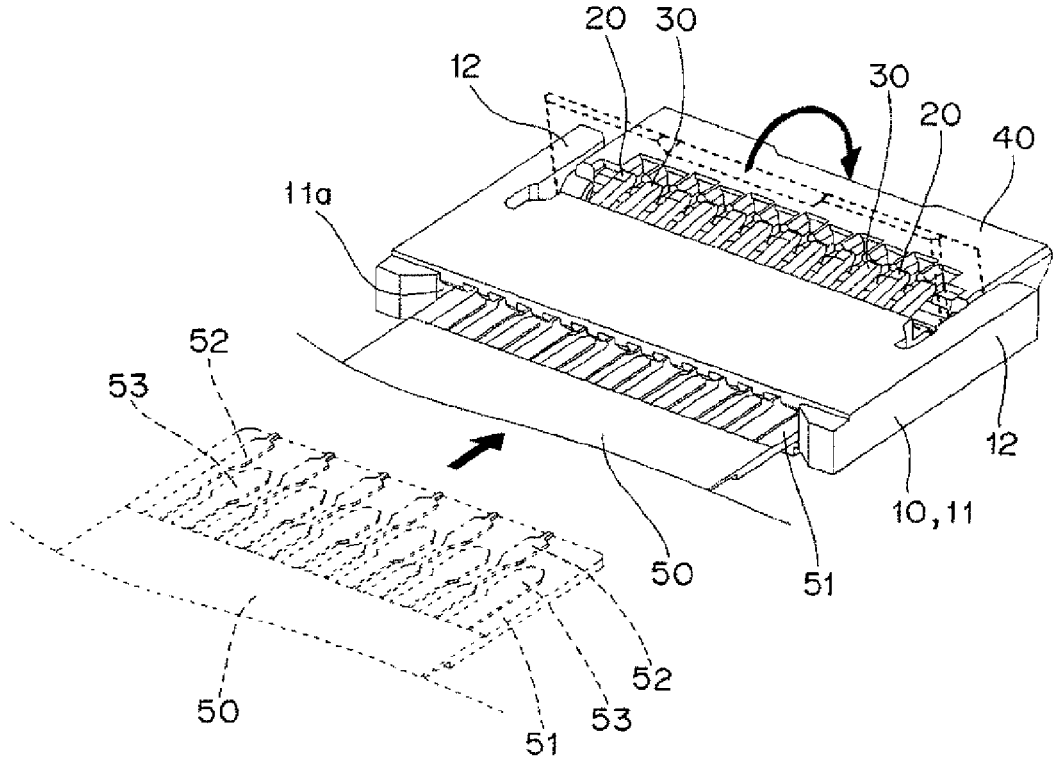
FIG. 5 shows a perspective view describing a method of connecting a flexible printed circuit board to the connector shown in FIG. 1.

As shown in FIG. 5, the flexible printed circuit board 50 connected to the connector 10 according to the present embodiment has first and second connecting portions 52, 53 printed wired on the upper surface of the distal end 51 alternately arranged side by side in a zigzag manner.

A method of assembling the above described components will be described below.

First, the first end 20*a* of the first connection terminal 20 is inserted to the first insertion hole 13 from the front surface side of the base 11. The slip-out preventing projection 21 arranged at the first connection terminal 20 thus is locked to a roof surface of the slip-out preventing portion 16 of the base 11, and the lock nail 26 is locked to the edge of the base 11, to be thereby positioned.

The first end 30*a* of the second connection terminal 30 is then inserted to the second insertion hole 14 along the guide groove 15*b* arranged in the guide plate 15 of the base 11. The protrusion 36 arranged at the intermediate part of the second connection terminal 30 then contacts the slip-out preventing recess 17 of the base 11, and the lock nail 37 locks the slip-out preventing recess 17 while pushing out the same in the up and down direction. At the same time, the lock nail 33 is locked to the edge of the base 11 to be thereby positioned (FIGS. 6 to 8).

In the present embodiment, the second end 30*b* of the second connection terminal 30 has a flat upper surface, a large geometric moment of inertia, and a large rigidity, and thus has an advantage of being less likely to buckle.

The operation receiving portions 24, 35 of the first and the second connection terminals 20, 30 are then respectively inserted to the pass-through holes 43 of the operation lever 40, the operation lever 40 is sled along the upper surface of the second connection terminal 30, and the operation receiving portions 24, 35 are pushed up by the cam portion 42 to be pushed in an elastically deformed state. The cam portion 42 thereby fits into the rotation recess 38 of the second connection terminal 30, the rotation shaft 41 fits into the bearing slit 12*b* of the base 11, and the operation lever 40 is rotatably supported.

Figure 6A:
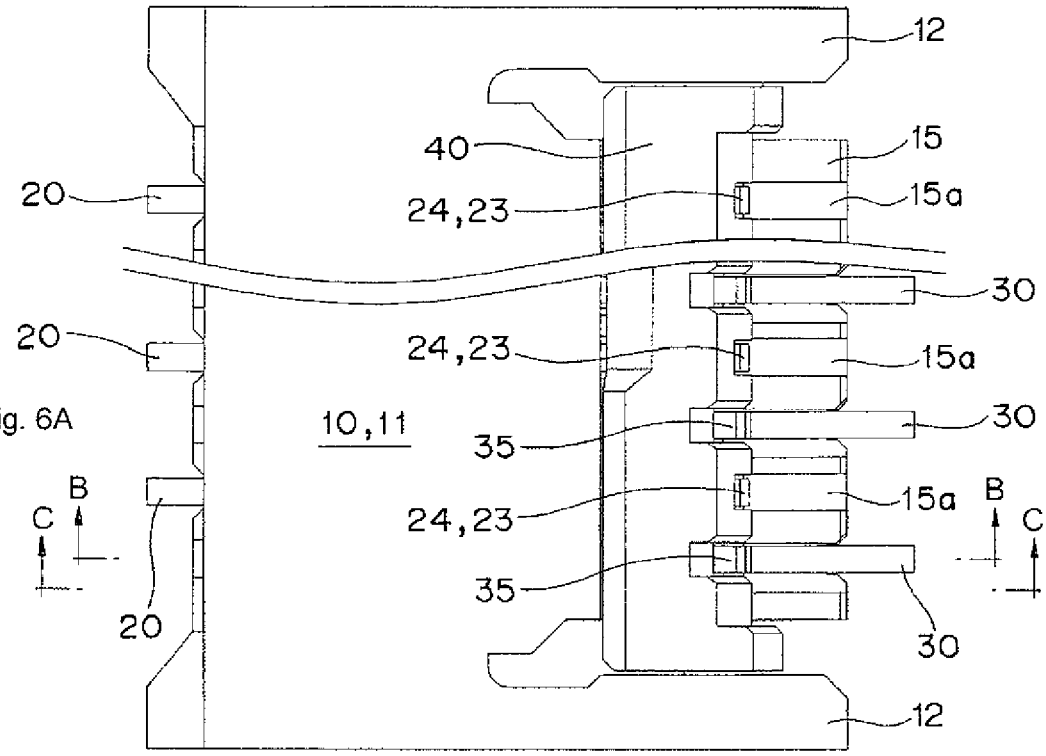
FIG. 6A and FIGS. 6B and 6C show a plan view and partial cross-sectional views describing an operation method of the connector shown in FIG. 1.
Figure 6B:
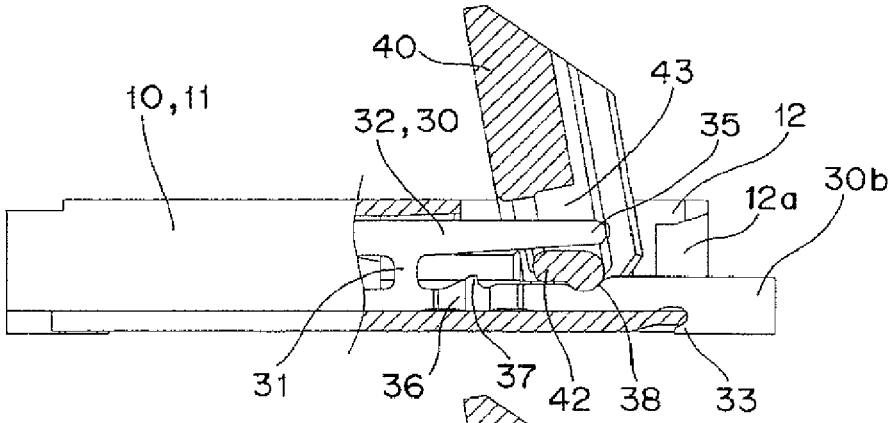
Figure 6C:
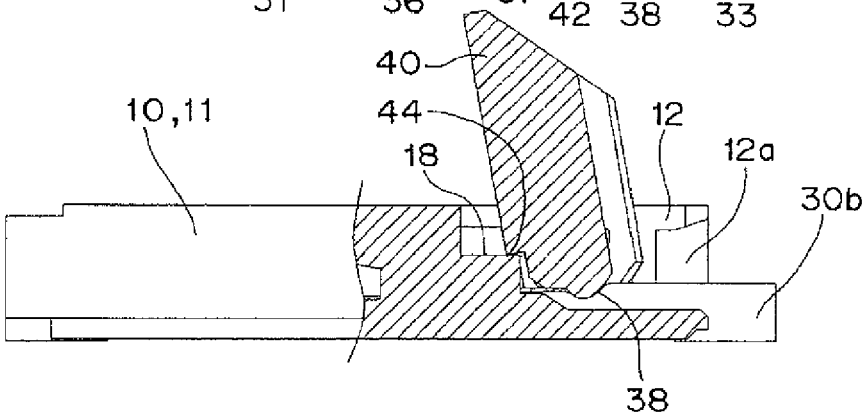
Figure 7A:
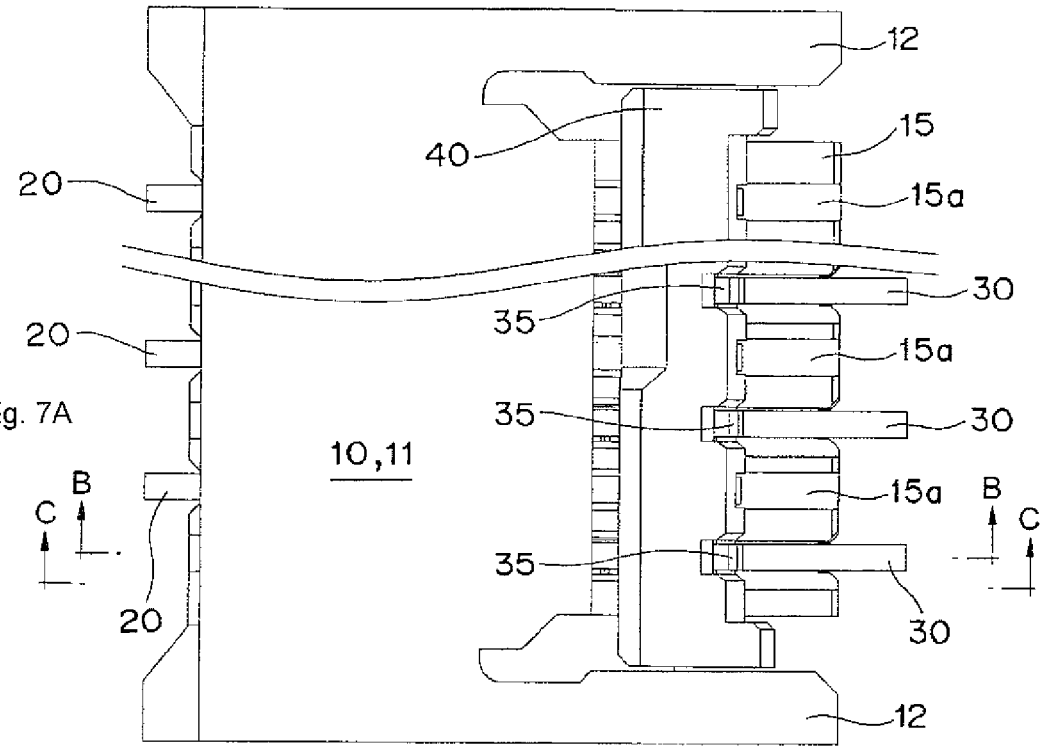
FIG. 7A and FIGS. 7B and 7C show a plan view and partial cross-sectional views describing an operation method of the connector following FIG. 6.
Figure 7B:
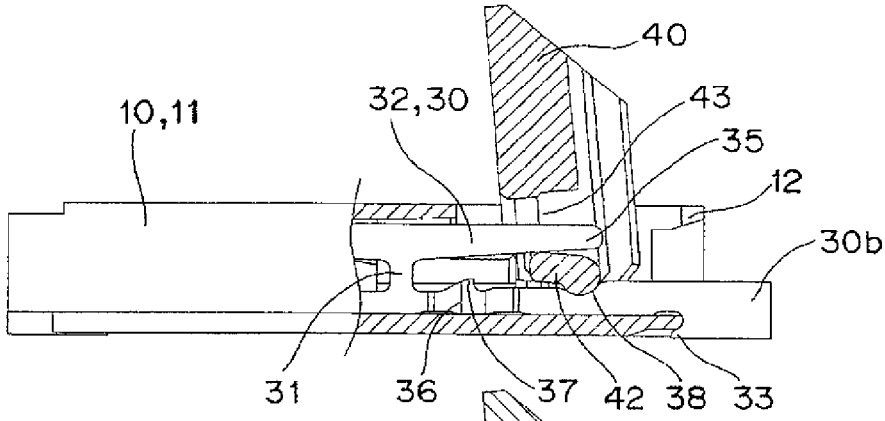
Figure 7C:
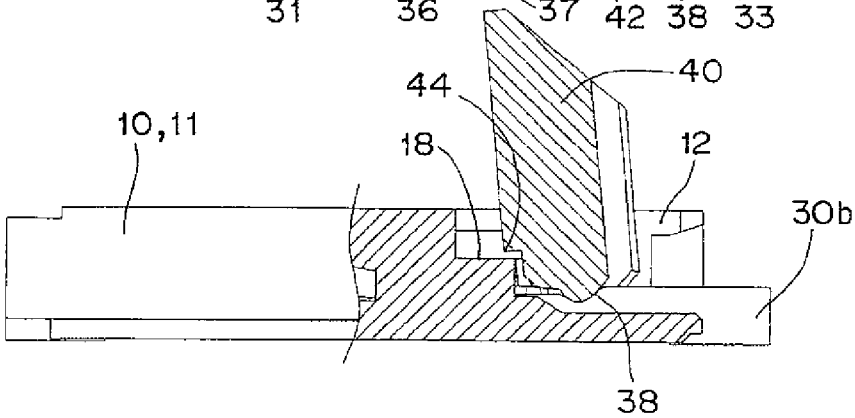
Figure 8A:
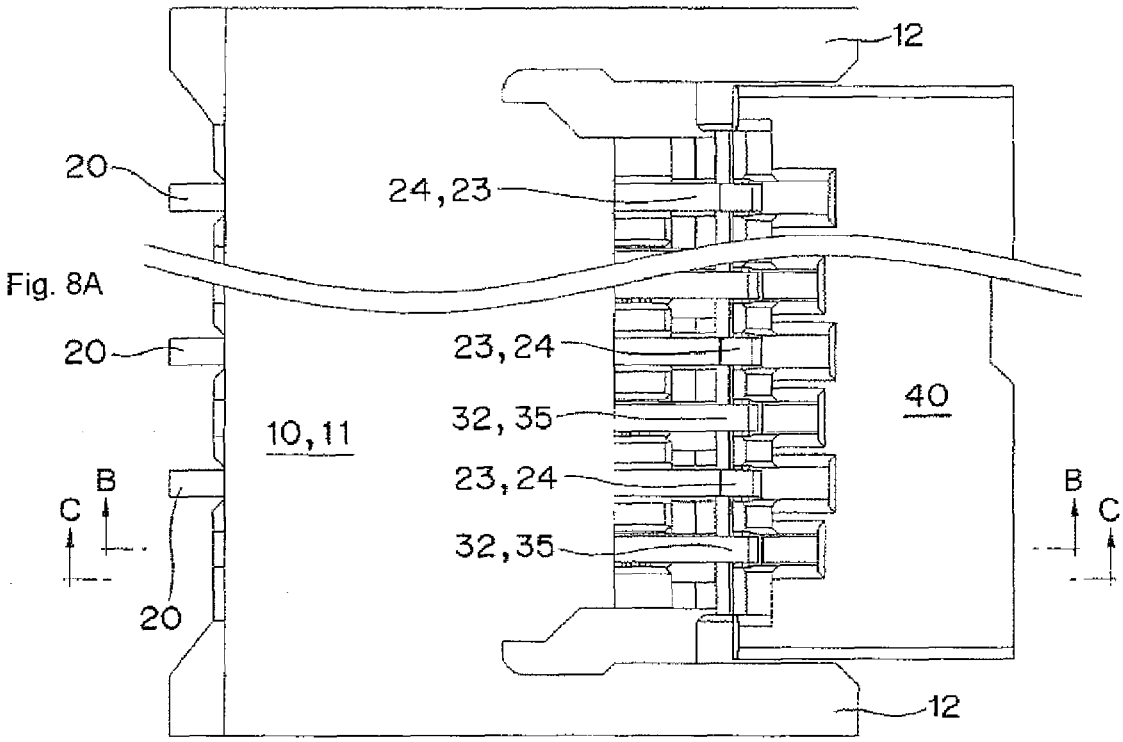
FIG. 8A and FIGS. 8B and 8C show a plan view and partial cross-sectional views describing an operation method of the connector following FIG. 7.
Figure 8B:
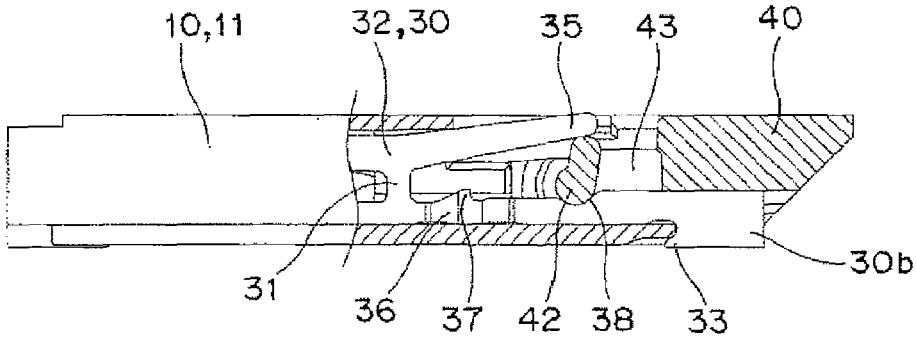
Figure 8C:
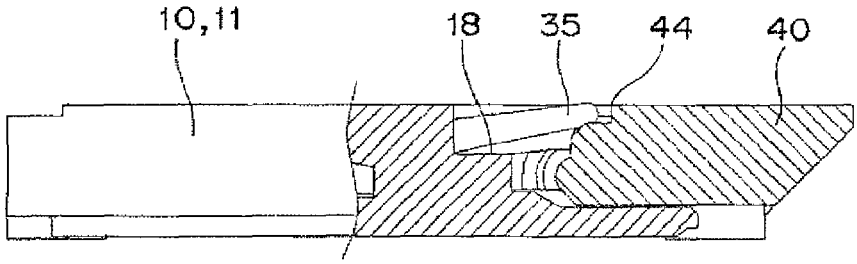

As shown in FIGS. 7 and 6, according to the present embodiment, even if the operation lever 40 is excessively rotated to the opening side, the contact portion 44 formed at the edge of the upper surface of the operation lever 40 rides over the position regulating surface 18 of the base 11 thereby lifting the operation lever 40 upward before the upper surface of the operation lever 40 contacts the edge of the upper surface of the base 11. Thus, the rotation force of the operation lever is greatly divided to the upper side. As a result, the rotation force of the operation lever 40 is less likely to be divided in the horizontal direction, and the second connection terminal 30 is not pushed out from the base 11.

In particular, when transporting the connector 10 over a long distance after the completion of the assembly, the second connection terminal 30 does not slip out from the base 11 even if microscopic vibration is applied on the operation lever 40 and the operation lever 40 repeats microscopic rotation operation.

Furthermore, even if an impact force more than expected, for example, an impact force from dropping of a package container is applied on the connector 10 individually stored in the package container (not shown), the position of the operation lever is always regulated with respect to the base 11, and thus the second connection terminal 30 does not slip out from the base 11.

A method of connecting and fixing the flexible printed circuit board 50 to the connector 10 will now be described based on FIGS. 5 to 8.

As shown in FIG. 5, the distal end 51 of the flexible printed circuit board 50 is inserted to the opening 11*a* of the base 11 until the distal end 51 of the flexible printed circuit board 50 hits an inner side surface of the base 11. The operation lever 40 is then rotated and pushed down with the axis center of the rotation shaft 41 as the center, whereby the cam portion 42 simultaneously pushes up the operation receiving portions 24, 35 of the first and the second connection terminals 20, 30, as shown in FIGS. 7 and 8. The substantially T-shaped operation pieces 23, 32 having the supports 22, 31 as the supporting point then tilts, and each of the first and the second movable contacting points 25, 34 pressure-contacts and conducts to the first and the second connecting portions 52, 53, respectively, arranged at the distal end 51 of the flexible printed circuit board 50.

In the present embodiment, since the cross-section of the cam portion 42 has a substantially elliptical shape, a distinct operation feeling is obtained as the rotation moment suddenly lowers when rotated by a predetermined angle.

When detaching the flexible printed circuit board 50 from the connector 10, the cam portion 42 is inverted by rotating the operation lever 40 in the opposite direction, whereby the bending moment on the operation receiving portions 24, 35 of the first and the second connection terminals 20, 30 is canceled, the connection state of the first and the second movable contacting points 25, 34 with respect to the first and the second connecting portions 52, 53 is released, and thereafter, the flexible printed circuit board 50 is pulled out.

According to the present embodiment, as shown in FIG. 5, since the first and the second connecting portions 52, 53 of the flexible printed circuit board are arranged in a zigzag manner, mounting density is further increased, miniaturization is facilitated, and contact reliability is enhanced.

The contact portion of the operation lever may be an acute angle or an obtuse angle, or may be a round surface. The position regulating surface of the base is not limited to a flat surface, and may be a tapered surface.

Furthermore, the position regulating surface may be formed at the operation lever, and the contact portion may be formed at the base.

The connector 10 according to the present invention is not limited to the connector described above, and is obviously applicable to other connectors.

What is claimed is:

1. An electrical connector comprising:

a base having an opening to which a distal end of a flexible printed circuit board is inserted formed on a front surface, a plurality of insertion holes passing from the front surface to a rear surface adjacently arranged at a predetermined pitch, and a position regulating surface of one step lower formed at an edge of an upper surface on the rear surface side;

a connection terminal to be inserted to the insertion hole from the rear surface side, the connection terminal being arranged in a projecting manner with a substantially T-shaped operation piece having, at a first end, a movable contacting point that pressure-contacts a connecting portion adjacently arranged at the distal end of the flexible printed circuit board; and an operation lever having an upper surface of the connection terminal as a rotation supporting point, including a cam portion for driving an operation receiving portion positioned at a second end of the operation piece, and being formed with a contact portion that rides on a position regulating surface of the base at an edge of the upper surface on the front surface side;

wherein when the operation lever is rotated for opening, the contact portion of the operation lever rides on the position regulating surface of the base before the upper surface of the operation lever contacts the edge of the upper surface on the rear surface side of the base, so that the operation lever is lifted upward.

2. The connector according to claim 1, wherein a rotation recess acting as a rotation supporting point of the cam portion of the operation lever is arranged on the upper surface of the connection terminal.

* * * * *